United States Patent [19]

Bubley et al.

[11] 4,242,956

[45] Jan. 6, 1981

[54] TAKEOFF APPARATUS FOR A WICKET DRYER

[75] Inventors: Henry J. Bubley, Deerfield; Melvin E. Green, Chicago; Alex Iaccino, Mount Prospect, all of Ill.

[73] Assignee: American Screen Printing Equipment Company, Chicago, Ill.

[21] Appl. No.: 877,245

[22] Filed: Feb. 13, 1978

[51] Int. Cl.[3] ..... B41F 15/12; B41F 21/08

[52] U.S. Cl. ..... 101/123; 101/408; 101/416 A; 271/85; 271/DIG. 10; 34/150

[58] Field of Search ..... 101/416 A, 416 R, 114, 101/117, 118, 123, 126, 232, 408; 34/150, 184, 186, 109, 149, 189, 190; 198/486, 485, 649, 650, 633, 480; 271/267, 268, 66, 69, 72, 83, 84, 85, DIG. 10

[56] References Cited

U.S. PATENT DOCUMENTS

| | | | |
|---|---|---|---|
| 1,434,504 | 11/1922 | Schlafly | 34/150 X |
| 1,468,181 | 9/1923 | Wagner et al. | 198/649 X |
| 1,853,478 | 4/1932 | Vincent | 198/649 X |
| 2,302,730 | 11/1942 | Woolford | 34/150 X |
| 3,762,066 | 10/1973 | Key | 34/150 |
| 3,860,231 | 1/1975 | Oltra | 271/85 |
| 4,031,824 | 6/1977 | Bubley et al. | 101/126 |

OTHER PUBLICATIONS

M & M Research Engineering, Inc., 13111 W. Silver Spring Drive, Butler, Wisconsin, "Screen Printing Equipment"-Catalog 1070, pp. 9, 14, 15 and 16.

*Primary Examiner*—J. Reed Fisher

*Attorney, Agent, or Firm*—Robert E. Wagner; Gerald T. Shekleton

[57] ABSTRACT

A cantilevered takeoff apparatus is provided by the present invention which is particularly adapted to automatically remove printed stock from the bed of a screen printing press and transfer the stock to a wicket dryer, having a plurality of rows of wickets movable along the upper and lower surfaces of the dryer frame, where the stock is released face up on a row of wickets for drying. The cantilevered takeoff apparatus herein enables the wicket dryer to be positioned directly beneath the printed work to receive the work as it is transferred thereto, without obstructing the path of the rows of wickets during operation.

1 Claim, 5 Drawing Figures

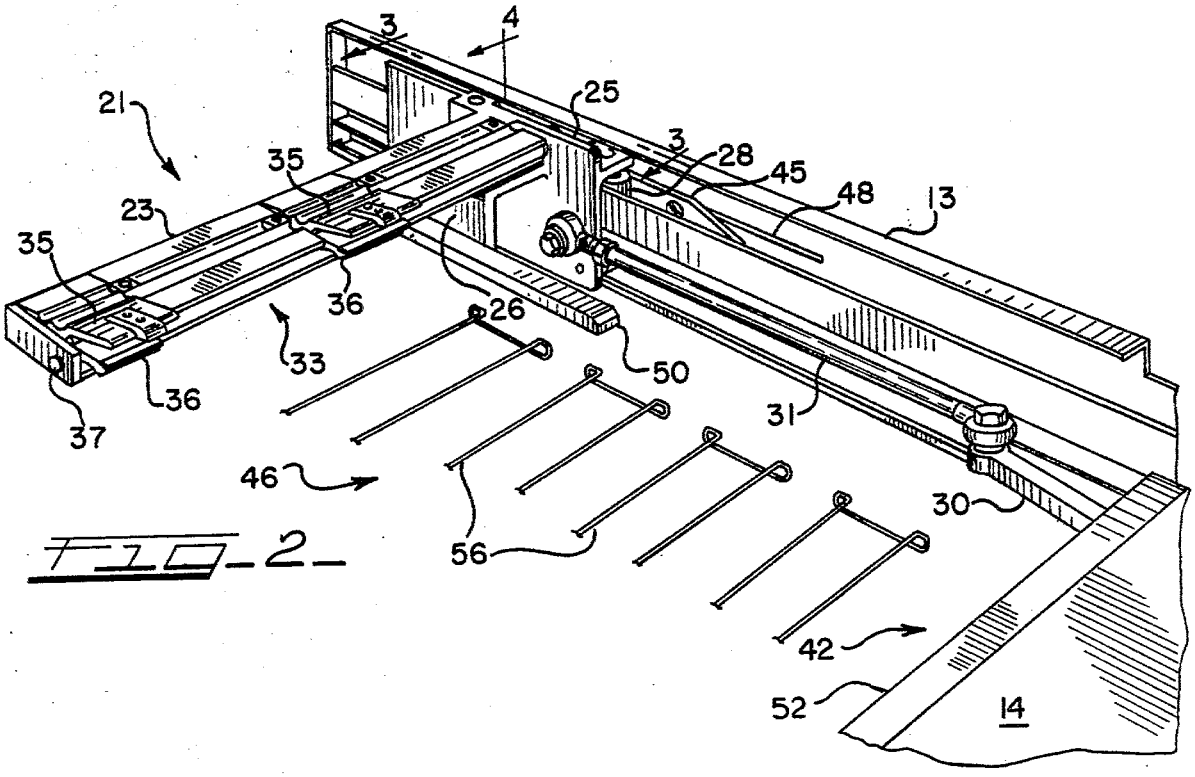
FIG. 2
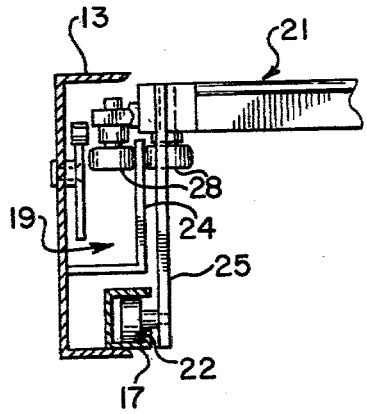
FIG. 5
FIG. 4
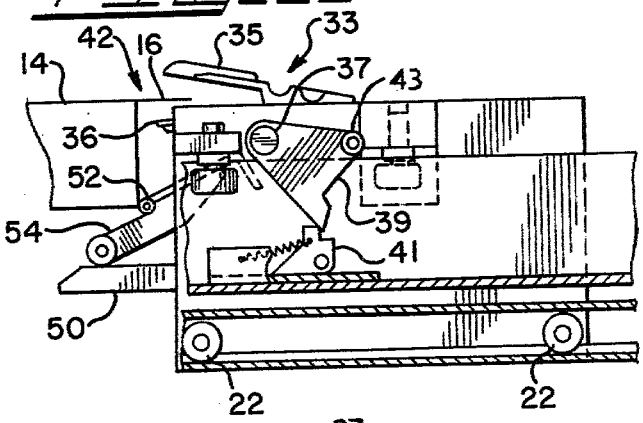
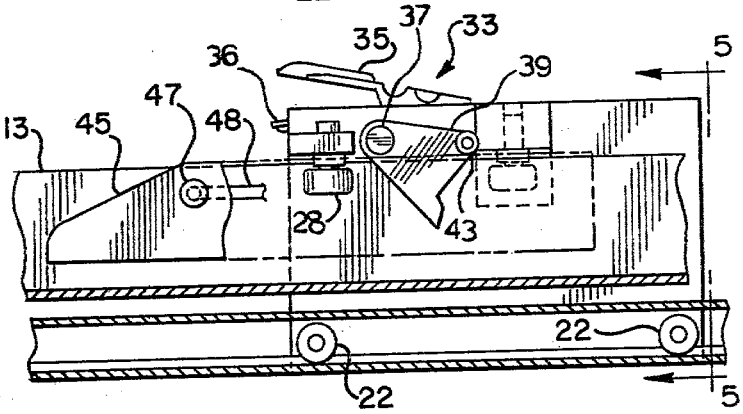
FIG. 3

TAKEOFF APPARATUS FOR A WICKET DRYER

BACKGROUND OF THE INVENTION

A persistent problem associated with screen printing is to provide sufficient drying time using ambient art prior to stacking to avoid smearing of newly printed stock. Immediate stacking is undesirable for several reasons. A slight shifting of the stock during the stacking process or when the stock is moved for storage only results in smearing the ink. Premature stacking before drying is complete, results in the sheets sticking together. Excessive drying time is unacceptable for most smaller operations having limited plant space since stock must be removed from the premises relatively soon after printing to make room for additional stock.

Some types of existing screen printing presses have apparatus for the automatic takeoff of printed work, and generally provide for the work to be conveyed to a dryer after removal from the bed or dried by ambient air while on the conveyor. In these types of presses, a transfer carriage having gripper means is reciprocated along a pair of parallel channels. The carriage is first registered to a position adjacent the bed of the press to grip the edge of a piece of stock after it is printed, and then the carriage is placed in a delivery position where the work is released by the gripper means onto the conveyor. Where ambient air is used, the drying time is limited to the length of the convey or travel.

Accordingly, various types of drying schemes have been developed to increase the drying time of newly printed work prior to stacking. One of the most inexpensive and efficient types of dryers yet developed is the wicket dryer. A wicket dryer comprises a plurality of rows of wickets, each row supporting a separate piece of stock, which are mounted at spaced intervals along the upper and lower surfaces of a dryer frame for travel therealong.

The primary advantage of a wicket dryer, in addition to the low costs of purchase and operation, is the excellent and efficient use of plant space. Many existing dryers employ a conveyor belt which advances stock placed thereon through a drying chamber wherein warm air is circulated or heating elements are provided to dry the ink. The problem with these dryers is that stock must be placed face up on the belt and, depending upon the size of the stock to be dried, only a relatively few separate pieces of stock may be placed on the belt at one time unless an overly lengthy belt is used. The artificial dryer also requires large amounts of energy which adds to the cost of printing.

The wicket dryer, however, carries the stock upright as it dries with ambient air, greatly increasing the number of pieces of stock that can be dried at one time in a given space as compared to belt dryers. One problem with the use of wicket dryers prior to the present invention, was that they had to be hand fed since known automatic takeoff apparatus, of the kind described above, were not adaptable for automatic feed to wicket dryers. When a row of wickets reaches either end of the dryer frame, it is pivoted to the opposite surface of the frame. The row of wickets shown in FIG. 1 is depicted in a position mid-way between the upper and lower surfaces of the frame. It is apparent that existing types of takeoff apparatus having a transfer carriage reciprocated along two spaced parallel channels would not be suitable for automatic synchronization with a wicket dryer, since at least one of the channels would interfer with the pivotal movement of the rows of wickets. At best, these types of takeoff apparatus allow only manual feeding of the wicket dryer after the work is released at the delivery position.

SUMMARY OF THE INVENTION

In view of the necessity for a lengthened drying time to prevent potential smearing of newly printed stock, and in the interest of taking full advantage of the reduced cost and space saving characteristics of wicket dryers, the present invention provides a cantilevered takeoff apparatus which is particularly adapted for use with wicket dryers and, in particular, the wicket dryer disclosed in co-pending U.S. patent application Ser. No. 877,330, filed Feb. 13, 1978, now abandoned, by Bubley et al., entitled "Wicket Dryer" and assigned to the same assignee as the present invention.

The cantilevered takeoff apparatus of the present invention solves the problem of automatic synchronization of screen printing presses with the type of wicket dryers disclosed in the above named application. As discussed in detail below, the takeoff apparatus of the present invention includes a takeoff or transfer carriage mounted on a cantilevered channel or support arm for reciprocation to and from the bed of the press for removal of newly printed stock. Use of a single support arm enables the wicket dryer to be placed in a position such that a row of wickets is registered directly beneath the takeoff apparatus, in a position to receive newly printed work as it is released by the transfer carriage. As the transfer carriage is reciprocated back to the press bed to remove another piece of stock, the row of wickets upon which the stock was just placed is free to continue rotation to the upper surface of the dryer since no second channel or support arm obstructs its path.

More specifically, the takeoff apparatus of the present invention consists of a single cantilevered support arm which is readily attached adjacent the printing bed of a commercially available screen printing press. Mounted near the base of the support arm is a channel, the open side of which faces outwardly from the support arm. The edge of one leg of an angle iron is fixed to the support arm such that the angle iron faces inwardly toward the support arm. A takeoff transfer carriage is mounted on the channel and angle iron for reciprocation along the length of the support arm by a pair of rollers mounted near the base of the transfer carriage which are disposed within the channel for movement therealong, and a second pair of rollers mounted on either side of the angle iron to maintain the transfer carriage in a horizontal position for travel along the support arm.

The takeoff transfer carriage consists of a pair of gripper jaws, the construction and function of which are substantially disclosed in the U.S. Pat. No. 4,058,307, Bubley, et al. entitled "Feed and Takeoff Assembly" which is assigned to the same assignee as the present invention, and is incorporated herein by reference thereto. Generally, the bottom jaw of the takeoff gripper jaws is mounted on a rod extending the length of the transfer carriage, and the movement of the upper jaw is coordinated with that of the lower jaw such that as the rod is pivoted, the jaws are moved apart in a position to grip printed work.

The present invention may also be adapted for use with a drop edge printing bed similar to that disclosed in the above-identified U.S. Pat. No. 4,058,307. The present invention is additionally provided with a stop means attached to the drop edge of the printing bed, which is hinged at its base. Mounted on the transfer carriage in alignment with the stop means is a trip bar which contacts the stop means of the drop edge as the transfer carriage advances near the printing bed, causing the drop edge to pivot about its hinge and drop down to allow the takeoff grippers access to the printing bed to grip the printed work.

The drive mechanism of the screen printing press such as that disclosed in the above named U.S. Pat. No. 4,058,307, is connected to the wicket dryer identified above by electrical or mechanical means such that as the takeoff assembly removes printed work from the printing bed, a row of wickets from the wicket dryer are moved to a horizontal position relative to the printing bed to receive the printed work. The transfer carriage is reciprocated away from the printing bed and delivers the work to a position over the row of wickets, whereupon the jaws are opened and the work is deposited, face up on the wickets for drying. An adjustment mechanism on the support member provides for variation in the delivery position according to the size of the work printed.

Accordingly, it is an object of this invention to provide an efficient, automatic cantilevered takeoff apparatus for use with a wicket dryer.

It is another object of this invention to association with the drive mechanism of a screen printing press which may be synchronized with a wicket dryer such that a row of wickets is registered to a position to receive the printed work as the takeoff transfer carriage delivers the work to the takeoff position.

Objects in addition to the foregoing will become apparent upon examination of the following description taken in conjunction with the drawings wherein:

DESCRIPTION OF THE DRAWINGS

FIG. 2 is a perspective view of the present invention showing the takeoff apparatus connected to the drive mechanism of a printing press which reciprocates the transfer carriage along the support arm;

FIG. 3 is a cut away view of the end of the transfer carriage mounted on the support arm taken along line 2—2 of FIG. 2 showing the carriage in a delivery position wherein the stock is released onto the wicket dryer;

FIG. 4 is a cut away view of the end of the transfer carriage mounted on the support arm showing the carriage in position adjacent the printing bed of the press with the takeoff grippers in an open position and the drop edge of the press pivoted downward; and, FIG. 5 is a cross sectional view in full elevation taken generally along the line 5—5 of FIG. 3 showing the transfer carriage as mounted on the support arm.

DETAILED DESCRIPTION OF THE INVENTION

Figure 1:
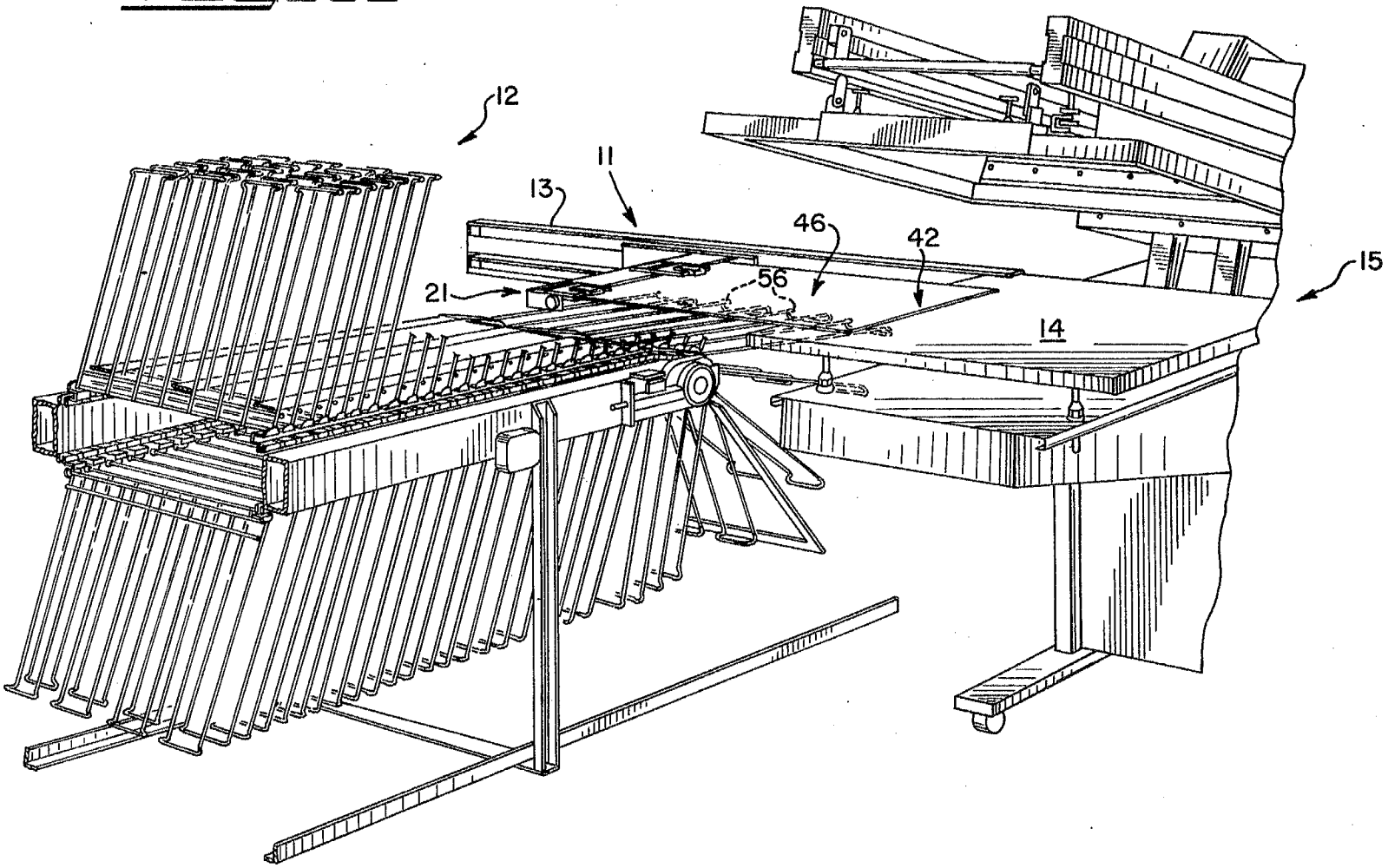
FIG. 1 is a perspective view of portions of a screen printing press having the takeoff apparatus of the present invention and a wicket dryer, showing the wicket dryer in a position adjacent the press to receive printed work for drying.

Generally, referring to FIG. 1, the takeoff apparatus 11 of the present invention attaches at one end adjacent the printing bed 14 of a commercially available screen printing press 15. As discussed in detail below, the takeoff apparatus 11 provides for automatic feeding of a wicket dryer 12 as opposed to the manual hand feeding required when using existing types of takeoff apparatus. As mentioned above, a wicket dryer comprises a plurality of rows of wickets which travel in a loop-like path along the upper and lower surfaces of the dryer. At the ends of the dryer, the wickets travel in a loop or arc from one surface to the other. The takeoff apparatus 11 of the present invention includes a single support arm or channel 13 as opposed to the two parallel arms used in existing takeoff apparatus, which enables the dryer 12 to be positioned directly beneath the takeoff apparatus 11 to receive printed work removed from the bed 14 by the takeoff apparatus 11 without obstructing the path of the wickets at the end of the dryer 12. A takeoff transfer carriage, generally labeled as 21, has one end movably mounted on arm 13 for the automatic removal of printed stock from the printing bed 14 to a delivery position 46, as discussed in detail below. The transfer carriage 21 consists of an arm 23 having one end fixedly attached to a plate 25. A support angle 26 is mounted to plate 25 and extends outwardly from plate 25 a distance underneath arm 23 to help support the carriage 21 in a horizontal position, as will be seen below (see FIG. 2).

The transfer carriage 21 is mounted for reciprocal movement along support arm 13 by means of upper and lower rollers 28 and 22, as shown in FIG. 5. A channel 17 is mounted along the length of the base of support arm 13, the open side of which faces outwardly away from arm 13. A pair of lower rollers 22 are mounted to plate 25 such that they are disposed within channel 17 for movement therealong. Lower rollers 22 carry much of the weight of transfer carriage 21 as it reciprocates along support arm 13. An L-shaped angle iron 19 is also mounted to support arm 13 such that an end of one stem of the L-shape is fixed to arm 13 and the other upright stem 24 extends upwardly at a right angle to the fixed stem. As shown in FIG. 5, a pair of upper rollers 28 are mounted to carriage 21 on either side of the upright stem 24 of angle iron 19, in a horizontal relationship to the vertical axis of the upright stem 24. Upper rollers 28 maintain carriage 21 in a generally horizontal position for travel along support arm 13.

The removal of printed work from printing bed 14 is accomplished by a takeoff gripper assembly 33 which is mounted on the transfer carriage 21 as shown in FIG. 2. The takeoff gripper assembly 33, includes a series of transversely spaced upper jaws 35 pivotally mounted on a rod 37 extending the length of transfer carriage 21 to cooperate with a corresponding series of transversely spaced lower jaws 36, which are also pivotally mounted on rod 37. The structure and operation of gripper assembly 33 is disclosed in detail in U.S. Pat. No. 4,058,307, which is expressly incorporated in its entirety herein by reference thereto. In general, the upper jaws 35 are spring biased toward the lower jaws 36 such that they are normally in a closed position. When rod 37 is rotated, the lower jaws 36 mounted thereto are rotated downwardly which causes the upper jaws 35 to pivot upwardly on a camming surface of the lower jaws 36 thereby opening the jaws.

As shown in FIG. 4, the gripper assembly 33 is activated at the takeoff position 42 adjacent the printing bed 14 by means of a triangular cam follower 39 having one corner fixedly attached to rod 37. As the transfer carriage 21 is reciprocated to a takeoff position 42, the follower 39 contacts a spring biased trip dog 41 which causes the follower 39 to rotate with rod 37. The upper and lower jaws 35 and 36 are thus rotated apart to receive printed work 15 from the bed 14. As the takeoff carriage 21 begins to travel away from the bed 14, follower 39 moves off the trip dog 41 causing upper and lower jaws 35 and 36 to grip the printed work 15 as they close, for removal of the work 15 from the bed 14.

The carriage 21 is reciprocated away from the bed 14 and carries the printed work 16 to a delivery position 46 where it is released in the following manner. As shown in FIG. 3, a cam plate 45 is adjustably mounted in a slot 48 formed in support arm 13 at the delivery position 46. A roller 43, mounted on the rear corner of cam follower 39, rides up along cam plate 45 as the transfer carriage 21 is moved to the delivery position 46. As the roller 43 rides up on the front edge of cam plate 45, the rod 37 is rotated with follower 39, which opens upper and lower jaws 35 and 36 thereby releasing the printed work. The cam plate 45 is held in place by an adjustment screw 47, which is attached to cam plate 45 through a slot 48 formed part way along the support arm 13 (see FIG. 2). Depending on the size of the printed work, the position of the cam plate 45 may be adjusted by simply loosening adjustment screw 47 and moving cam plate 45 along the slot 48 to the desired position.

The takeoff apparatus 11 may be adapted for use with a drop edge printing bed similar to that disclosed in U.S. Pat. No. 4,058,307. As shown in FIGS. 4 and 2, a trip bar 50 is mounted near the base of plate 25 and extends outwardly a short distance beyond the plate 25. The drop edge 52 of bed 14, is an L-shaped member hinged to the printing press at its bottom. A stop 54 is fixedly attached to drop edge 52 and extends downwardly to engage with trip bar 50 as the transfer carriage 21 is moved toward the bed 14. As the trip bar 50 makes contact with stop 54, it causes the drop edge 52 to pivot downwardly about its hinge, as shown in FIG. 4. The trip bar 50 extends ahead of the plate 25 a sufficient distance to contact stop 54 and cause the drop edge 52 to pivot prior to the arrival of the takeoff gripper assembly 33 at the bed 14, such that the drop edge 52 does not obstruct the path of the gripper assembly 33 as it approaches the takeoff position 42 at the bed 14.

As shown in FIG. 2, the transfer carriage 21 is moved along support arm 13 by a connecting rod 31 which is attached at one end to the plate 25 and at the other end to the drive arm 30 of a drive crank assembly which operates the screen printing press and is disclosed in U.S. Pat. No. 4,058,307. Generally, the crank assembly consists of a series of drive arms interconnected by shafts which are driven by a main drive sprocket connected to a motor. The arms of the crank assembly fold up on one another in a scissors-like motion as it moves from right to left, enabling the transfer carriage 21 connected thereto by rod 31 to be moved a significant distance along arm 13 without the use of a correspondingly long drive arm 30 and an unmanagably wide press frame. The crank assembly used herein is turned at a 90° angle within the press frame from its position as disclosed in U.S. Pat. No. 4,058,307, to permit connection between drive arm 30 of the crank assembly and the connecting rod 31. The transfer carriage 21 is thereby reciprocated in a timed cycle with the operation of the screen printing press 15 such that upon completion of the print stroke, the carriage 21 is in the takeoff position 42 at the bed 14 to grip the newly printed work 16 for removal to the delivery position 46.

The takeoff apparatus 11 of the present invention is specifically designed for operation with wicket dryers, and particularly with the above-identified U.S. patent application entitled "Wicket Dryer", Ser. No. 877,330. As mentioned above, the single support arm 13 of the present invention enables the wicket dryer 12 to be positioned immediately beneath the delivery position 46 (see FIG. 1). The operation of the wicket dryer, as discussed in detail in the above-identified application, may be synchronized by electrical or mechanical means with the same drive crank assembly of the printing press, such that a row of wickets 56 is registered to the delivery position 46 to receive a piece of newly printed stock as the takeoff carriage 21 is moved to that position to release the stock. As the carriage 21 is reciprocated to the takeoff position 42, the row of wickets 56 which just received a sheet of stock, continues its rotational movement toward the upper surface of the dryer without the obstruction of the second support arm or channel used in existing types of takeoff apparatus, as discussed above.

Accordingly, a cantilevered takeoff apparatus is provided for the removal of printed work from a screen printing press. The takeoff apparatus is adapted to register all sizes of stock to an appropriate delivery position where the newly printed work may be deposited on a wicket dryer. Only one support arm is used in this unique takeoff apparatus, which allows the wicket dryer to be positioned directly beneath the printed work as it is registered to a delivery position. Thus, automatic synchronization of the press and wicket dryer is made possible, since the continuous pivotal movement of the dryer is not impaired by the single support arm herein as is the case is existing takeoff devices, having two support arms.

While the invention has been particularly shown and described with reference to a preferred embodiment thereof, it will be understood by those skilled in the art that various changes in form and details may be made therein without departing from the spirit and scope of the invention.

We claim:

1. A takeoff apparatus particularly adapted to automatically transfer stock from the printing bed of a screen printing press to a wicket dryer having a plurality of rows of wickets movable along the upper and lower surfaces of said dryer, said takeoff apparatus comprising:

a single elongated support arm, said support arm being mounted to said printing press at a corner of said printing bed;

a transfer carriage movable along said support arm between a takeoff position adjacent said printing press and a delivery position adjacent said wicket dryer;

mounting means for mounting an end of said transfer carriage to said support arm for movement therealong, said mounting means including a channel attached to said support arm, a pair of first rollers vertically mounted to said transfer carriage, said first rollers being disposed within said channel for movement therealong, an angle iron comprising a fixed stem perpendicular to an upright stem, the end of said fixed stem being mounted to said support arm, a pair of second rollers horizontally mounted to said transfer carriage, said rollers being disposed on opposite sides of said upright stem of said angle iron for movement therealong, whereby said first and second rollers support one end of said transfer carriage on said support arm for reciprocation therealong; and, gripper means mounted to said transfer carriage, said gripper means being operable to grip said printed stock on the printing bed at said takeoff position, and to release said printed stock face-up on a row of said wickets beneath said transfer carriage at said delivery position, whereby said row of wickets move upwardly from beneath said transfer carriage at said delivery position without contacting said support arm toward the upper surface of said dryer for drying said printed stock.

* * * * *

UNITED STATES PATENT OFFICE

CERTIFICATE OF CORRECTION

PATENT NO. 4,242,956

DATED January 6, 1981

INVENTOR(S) Henry J. Bubley, Melvin E. Green and Alex Iaccino

It is certified that error appears in the above-identified patent and that said Letters Patent are hereby corrected as shown below:

In column 1, line 7, the word appearing as "art" should read -- air --.

In column 3, after line 27, the following should be inserted:

-- It is another object of this invention to provide a cantilevered takeoff apparatus adaptable for use with a screen printing press for removal of printed work from the printing bed thereof and delivery to a point where the work may be placed on a row of horizontal wickets of a wicket dryer. --

In column 3, line 28, after the words "invention to", the following should be inserted: -- provide a cantilevered takeoff apparatus adapted for --

Signed and Sealed this

*Twenty-second* Day of *September 1981*

[SEAL]

*Attest:*

GERALD J. MOSSINGHOFF

*Attesting Officer*

*Commissioner of Patents and Trademarks*